US005918564A

United States Patent [19]

Ohtsuka et al.

[11] Patent Number: 5,918,564

[45] Date of Patent: Jul. 6, 1999

[54] SEAT FOR WATERCRAFT

[75] Inventors: Kenichi Ohtsuka; Kazuyoshi Kaneko; Satoshi Tanigaki, all of Iwata, Japan

[73] Assignee: Yamaha Hatsudoki Kabushiki Kaisha, Japan

[21] Appl. No.: 08/843,785

[22] Filed: Apr. 21, 1997

[51] Int. Cl.[6] ..... B63B 17/00

[52] U.S. Cl. ..... 114/363; 114/55.57

[58] Field of Search ..... 114/270, 363, 114/55.57; 440/88, 38; 297/195.1, 195.11, 214, 452.27; 521/54

[56] References Cited

U.S. PATENT DOCUMENTS

| | | | |
|---|---|---|---|
| 4,108,928 | 8/1978 | Swan, Jr. . | |
| 4,252,910 | 2/1981 | Schaefer . | |
| 4,457,524 | 7/1984 | Yoshiwara . | |
| 4,506,754 | 3/1985 | Hirano et al. . | |
| 4,524,529 | 6/1985 | Schaefer . | |
| 4,861,804 | 8/1989 | Nakanish . | |
| 4,982,682 | 1/1991 | Hattori | 114/363 |
| 5,189,747 | 3/1993 | Mundy et al. . | |
| 5,272,001 | 12/1993 | Weisman . | |
| 5,332,760 | 7/1994 | Weisman . | |
| 5,353,734 | 10/1994 | Tani | 114/363 |
| 5,418,257 | 5/1995 | Weisman . | |
| 5,490,474 | 2/1996 | Ikeda | 114/270 |
| 5,735,229 | 4/1998 | House et al. | 114/363 |
| 5,833,320 | 11/1998 | Kaneko et al. . | |

FOREIGN PATENT DOCUMENTS

| | | |
|---|---|---|
| 29 38 287 A1 | 4/1981 | Germany . |
| 41 00 155 A1 | 7/1992 | Germany . |
| 2-286481 | 11/1990 | Japan . |
| 3-37217 | 2/1991 | Japan . |
| 3-17848 | 3/1991 | Japan . |

*Primary Examiner*—Ed L. Swinehart

*Attorney, Agent, or Firm*—Knobbe, Martens, Olson & Bear, LLP

[57] ABSTRACT

A seat for a small watercraft includes a shock-absorbing member that helps to absorb shocks transmitted to the seat during watercraft operation. The seat and the watercraft are configured to protect the shock-absorbing member from heat and water damage. The watercraft includes a hull having a length and a width. The hull carries an engine and includes a raised pedestal. A plurality of ventilation devices are located along the length of the hull. The seat is supported by the raised pedestal and includes a seat base, a cushion arrangement, and a seat skin that substantially covers the cushion arrangement. The cushion arrangement includes a cushion and the aforementioned viscoelastic member. A seal is provided between the seat base and the raised pedestal to protect the viscoelastic member from water damage. The viscoelastic member is provided at least partially between a pair of the ventilation devices. The seat base includes a first base portion and a second base portion and a plurality of air flow openings. The first base portion is located under the cushion and the second base portion is located under the viscoelastic member. The area of the air flow openings in the first base portion is greater than the area of the air flow openings in the second base portion. Providing a greater air flow opening area in the first base portion of the seat base and providing the viscoelastic at least partially between the ventilation devices helps to protect the viscoelastic member from heat damage.

29 Claims, 4 Drawing Sheets

SEAT FOR WATERCRAFT

BACKGROUND OF THE INVENTION

This invention relates in general to a small watercraft and in particular to a small watercraft seat.

The seat of a personal watercraft includes a foam cushion that is supported by a rigid seat plate and is covered by a vinyl leather seat skin. This seat is generally satisfactory for most watercraft use; however, it is not satisfactory for rough water operation and wave jumping. During rough water watercraft operation and wave jumping, significant shocks are transmitted to the personal watercraft seat. This seat is uncomfortable during these activities because the seat does not have a construction that sufficiently dampens the large shocks transmitted to the seat.

A vehicle seat has been contemplated for a watercraft that effectively absorbs large shocks and vibrations transmitted to the seat. This seat includes a cushion arrangement that is supported by a seat base and covered by a seat skin. The cushion arrangement includes a cushion and a viscoelastic member. The viscoelastic member is preferably located along the undersurface of the cushion, between the cushion and the seat base. The viscoelastic member is constructed of a super-soft urethane elastomer that includes resinous microballoons. The viscoelastic member exhibits much of the shock-dampening qualities exhibited by the seat.

If this vehicle seat was incorporated into a personal watercraft, the viscoelastic member in the seat would suffer from heat damage and water damage, inhibiting the shock-dampening qualities exhibited by the viscoelastic member. In a personal watercraft, the bottom of the watercraft seat is located in close proximity to the heat-emitting engine and exhaust system. If the vehicle seat described above was incorporated into a personal watercraft, the viscoelastic member would be located in close proximity to these heat-emitting components. This vehicle seat is not designed to protect the viscoelastic member from the heat emitted by these personal watercraft components. Consequently, the viscoelastic member would become damaged by the heat from these components, inhibiting the shock-dampening characteristics of the viscoelastic member.

If this vehicle seat was incorporated into a personal watercraft, the viscoelastic member would also suffer from water damage because this seat is not designed to prevent water from seeping under the bottom of the seat. The viscoelastic member in this seat is either bonded to the undersurface of the seat or provided within a recess on the undersurface of the seat. If the vehicle seat described above was incorporated into a personal watercraft, water would seep under the seat, and into the cushion arrangement. Water between the cushion and viscoelastic member would inhibit the shock-absorbing characteristics of the viscoelastic member and would cause the viscoelastic member to become dislodged from its position relative to the cushion, inhibiting the comfort of the seat.

A watercraft seat was proposed in the past that inhibited water from entering the cushion through the bottom of the seat. This seat had a seat base with a plurality of air openings through which air could be expelled from the cushion upon compression of the cushion and returned upon expansion of the cushion. In one embodiment of the seat, a bag was hermetically sealed with these openings so that air could flow into and out of the seat while preventing the ingress of water into the cushion. In another embodiment, a gasket was provided near the periphery of the seat base, around the openings in the seat base. This gasket inhibited water from seeping between the bottom of the seat base and a raised pedestal of the hull. However, this seat suffered from the same drawbacks as the watercraft seat first mentioned above. The seat did not sufficiently absorb shocks transmitted to the seat during rough water operation and wave jumping.

It will be shown in the ensuing description of the present invention how the present invention solves these problems.

SUMMARY OF THE INVENTION

One aspect of the invention lies in the recognition that if a vehicle seat containing a viscoelastic member were incorporated into a personal watercraft, the viscoelastic member would be prone to heat and water damage, inhibiting the shock-dampening qualities of the viscoelastic member.

An additional aspect of the invention is adapted to be embodied in a seat for a small watercraft that includes a hull having a length and a width. The hull defines an engine compartment. A raised pedestal extends from the hull and includes an upper surface with an access opening provided in the upper surface. An engine is carried by the hull within the engine compartment. A plurality of ventilation devices are located along the length of the hull. A removable seat is supported by the raised pedestal and includes a seat base, a cushion arrangement, and a seat skin that covers the cushion arrangement. The cushion arrangement includes a cushion and a viscoelastic member. The viscoelastic member is provided between the cushion and the seat base and also at least partially between a pair of the ventilation devices. Providing the viscoelastic member at least partially between the ventilation devices keeps the viscoelastic well ventilated, protecting it from heat damage.

Another aspect of the invention is adapted to be embodied in a small watercraft seat constructed of a seat base and a cushion arrangement. The cushion arrangement is supported by the seat base and is substantially surrounded by a seat skin. The cushion arrangement includes a cushion member and a viscoelastic member. The seat base includes a plurality of openings that allow air to enter and escape the cushion arrangement. The seat base includes a first portion located under the cushion and a second portion located under the viscoelastic member. The area of the openings in the first portion is greater than the area of any openings in the second portion. Providing a greater opening area in the first portion allows air to enter and escape the cushion arrangement while inhibiting heat damage to the viscoelastic member.

A still further aspect of the invention is adapted to be embodied in a small watercraft seat that includes a seat base and a seat cushion arrangement. The seat cushion arrangement is provided on the seat base and is substantially surrounded by a seat skin. The seat cushion arrangement includes a cushion member and a viscoelastic member. The viscoelastic member is made of an urethane elastomer matrix that contains resinous microballoons. The viscoelastic member is provided between the seat cushion and the seat base. The viscoelastic member and the seat cushion have approximately the same reserve elastic modulus near the junction of these components. The reserve elastic modulus of the seat cushion at this location is between 0.020 Mpa and 0.040 Mpa. The reserve elastic modulus of the viscoelastic member at this location is between 0.022 Mpa and 0.040 Mpa. Designing the viscoelastic member and seat cushion to have approximately the same reserve elastic modulus near their junction provides a comfortable transition between these members.

BRIEF DESCRIPTION OF THE DRAWINGS

FIG. 3 is an enlarged cross-sectional view of a seat constructed in accordance with an embodiment of the invention taken along the length of the seat and shows a portion of a raised pedestal that the seat rests on.

DETAILED DESCRIPTION OF THE PREFERRED EMBODIMENT

Figure 1:
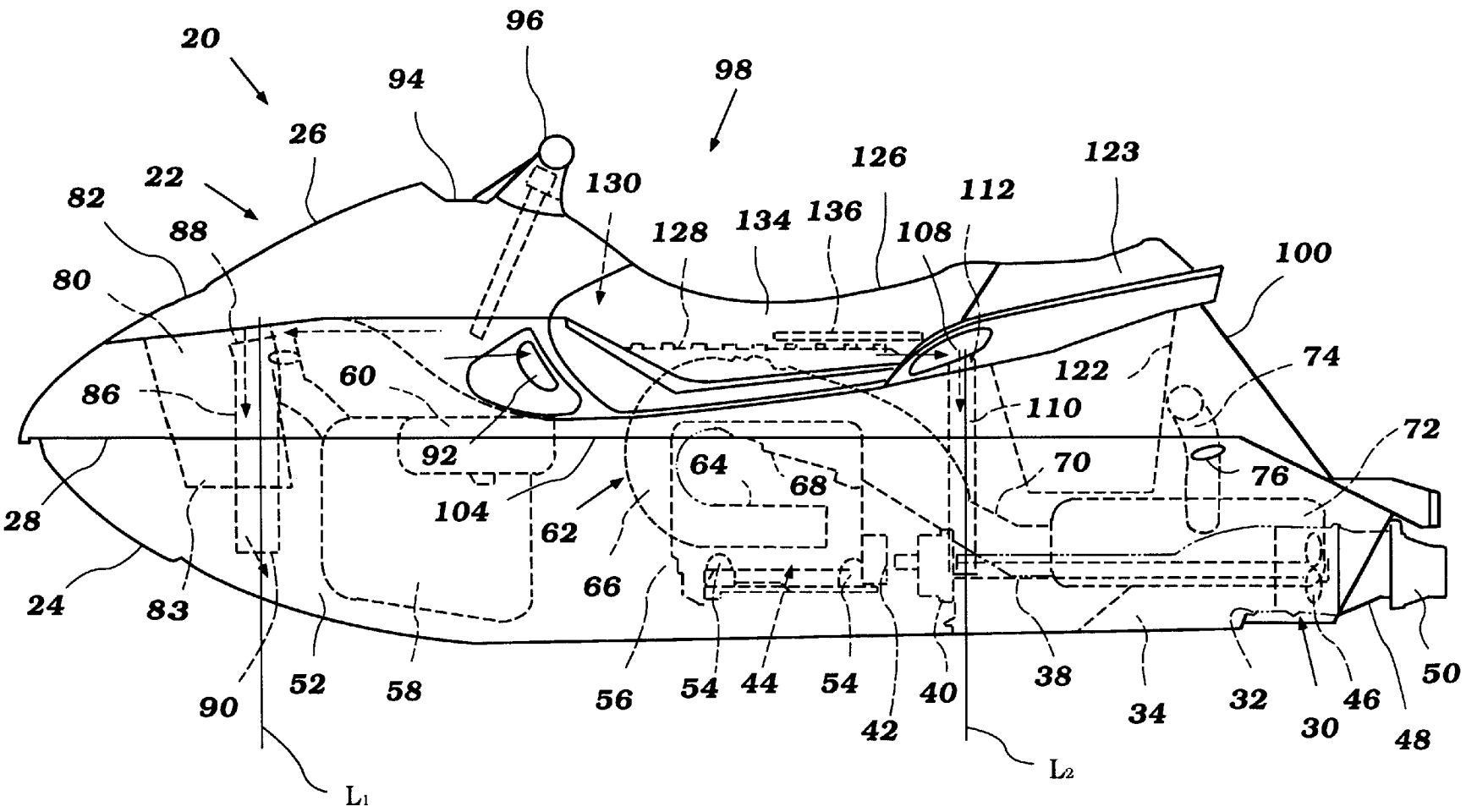
FIG. 1 is a side elevational view of a personal watercraft constructed in accordance with an embodiment of the invention and shows a variety of components in phantom.
Figure 2:
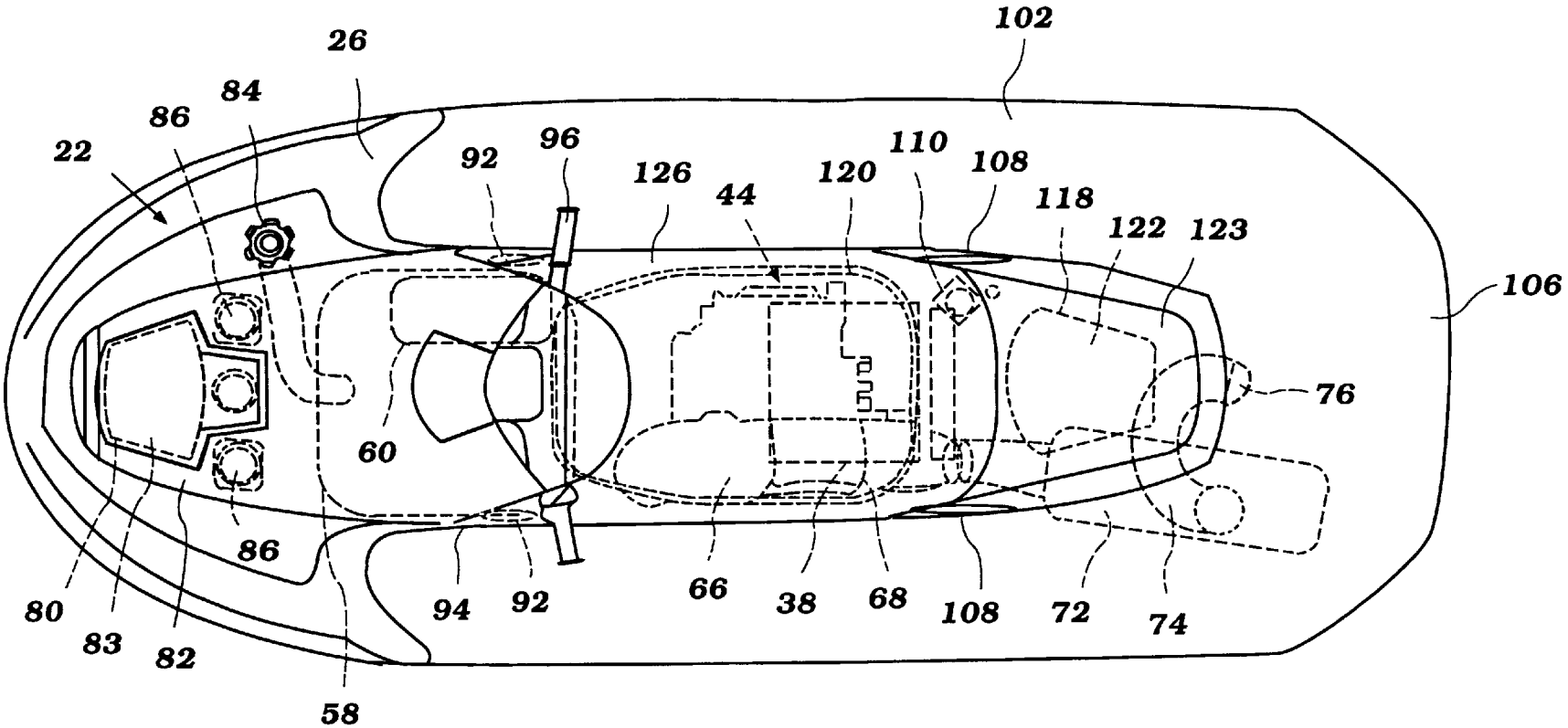
FIG. 2 is a top plan view of the personal watercraft of FIG. 1.

With reference to the drawings, and initially to FIGS. 1 and 2, a personal watercraft constructed in accordance with an embodiment of the invention is identified generally by the reference numeral 20. The personal watercraft 20 is comprised of a hull assembly, indicated generally by the reference numeral 22. The hull assembly 22 is comprised of a lower hull portion 24 and an upper deck portion 26. The lower hull and upper deck portions 24, 26 are formed from any suitable material such as molded fiberglass-reinforced plastic, or the like. The lower hull 24 and upper deck 26 are secured together along their peripheral edges by a flange 28.

The watercraft 20 is powered by a jet propulsion unit, indicated generally by the reference numeral 30, which is mounted in a tunnel near the rear of the lower hull 24. The jet propulsion unit 30 is comprised of an outer housing assembly that includes a water inlet duct-forming portion 32 that terminates in a downwardly facing water inlet opening 34. The inlet-duct forming portion 34 includes a forwardly extending tubular portion through which an impeller shaft 38 passes. The impeller shaft 38 is connected through a coupling 40 to a crankshaft 42 of an engine, indicated generally by the reference numeral 44, in a well-known manner. During use, water is drawn into the inlet opening 34 and through the inlet duct by an impeller 46. The impeller 46 is connected to the impeller shaft 38 and rotates therewith. The impeller 46 pumps water through straightening vanes (not shown), and through a discharge nozzle 48. From the discharge nozzle 48, the water flows through a steering nozzle 50. The steering nozzle 50 is pivotally connected to the discharge nozzle 48 for pivotal movement about a vertically extending axis.

The engine 44 is mounted within an engine compartment 52 formed within the hull 22, near the center of the watercraft 20, by engine mounts 54. The details of the engine 44 are not relevant to the present invention. Consequently, the engine 44 will only be generally described. The engine 44 includes a cylinder block 54 in which a plurality of cylinder bores are formed. Pistons reciprocate within these bores in order to drive the crankshaft 42 in a well-known manner. The engine 44 receives fuel from a fuel tank 58 located in a forward part of the engine compartment 52 and oil from an oil tank 60 located adjacent to the fuel tank 58.

An exhaust system, indicated generally by the reference numeral 62, includes an exhaust manifold 64 that receives the exhaust gases from the engine 44. A C-shaped pipe section 66 connects the exhaust manifold 64 to an expansion chamber device 68. The C-shaped pipe section 66 and expansion chamber device 68 extend above one side of the engine 44. Exhaust gases flow from the exhaust manifold 64, through the C-shaped pipe section, and into the expansion chamber 68. The expansion chamber device 68 includes an outlet portion that is connected to an exhaust pipe 70. The exhaust pipe 70, in turn, is connected to a water-trap device or water lock 72. Exhaust gases flow from the expansion chamber device 68, through the exhaust pipe, and into the water-trap device 72. As is well-known in the marine art, the water trap device 72 is designed to permit exhaust gases to exit and be discharged to the atmosphere in a location to be described while inhibiting water from entering the engine through the exhaust system 62. An exhaust outlet pipe 74 extends from the water trap device 72, and into the tunnel. The exhaust outlet pipe 74 terminates within the tunnel in a downwardly facing discharge end 76. Exhaust gases flow from the water trap device 72, through the exhaust outlet pipe 74, and out the discharge end 76. The discharge end 76 is located at or near the water line of the water in which the watercraft travels.

The front of the upper deck 26 includes a hatch 80 that is covered by a corresponding hatch cover 82. The hatch 80 receives a storage container 83.

Adjacent to the hatch 80, a fuel cap 84 is provided for covering a fuel delivery line 85 of the fuel tank 58.

Near the top of the hatch 80, a pair of vertically extending ventilation hoses 86 are provided. Each ventilation hose 86 includes an upper end 88 and lower end 90. The lower ends 90 of the ventilation hose 86 include a vertical axis L1. The upper ends 88 of the ventilation hoses 86 communicate with a pair of respective air inlets 92 located along opposite sides of a raised control area 94. Air flows into the air inlets 92, through respective passages along the sides of the raised control area 94, and into the upper ends 88 of the respective ventilation hoses 86. The ventilation hoses 86 direct the air into the engine compartment 52.

At the top of the raised control area 94, a handlebar assembly 96 is provided. The handlebar assembly is interrelated with the steering nozzle 50 in a well-known manner for steering the watercraft.

A rider's area 94 is provided in the upper deck 26 from the handlebar assembly 96 to the rear of the watercraft 20. A raised pedestal or raised deck area 100 extends vertically from the upper deck 26. The areas on the sides of the raised pedestal 100 form foot areas 102 on which the riders may place their feet. The outer sides of the foot areas 102 are bounded by raised gunnels 104 that protect the lower legs of the riders. The rear of the foot areas 102 preferably open into a rear deck upon which boarding can be made.

At upper comers of the raised pedestal 100, near the center of the raised pedestal 100, a second pair of air inlets 108 are provided. The air inlets 108 communicate with a vertically extending ventilation hose 110 through an air passage. The ventilation hose 110 includes and upper end 112 and a lower end 114. The lower end 114 of the ventilation hose 110 includes a vertical axis L2. Air flows into the air inlets 108, through the air passage, and into the upper end 112 of the ventilation hose 110. The ventilation hose 110 directs air into the engine compartment 52.

The respective air inlets 92, 108 and ventilation hoses 86, 110 form respective ventilation devices for ventilating the engine compartment. Ventilating the engine compartment 52 is desirable for a variety of reasons, such as supplying air to the engine, dissipating fuel fumes in the engine compartment 52, and dissipating heat emitted from the engine 44 and exhaust system 62. The importance of dissipating heat emitted from the engine will be discussed in more detail below.

The raised pedestal 100 includes an upper surface 116 in which a container opening 118 and engine access opening 120 are provided. The container opening 118 is located in a rear part of the upper surface 116 of the raised pedestal 100. A storage container 122 is partially disposed within this opening 118. A removable rear seat 123 is removably secured to a rear part of the raised pedestal 100 through a guide assembly (not shown) located near the front of the seat 124 and a latching assembly (not shown) located near the rear of the seat 124.

The engine access opening 120 is located in a front part of the upper surface 116 of the raised pedestal 100 and is defined by a flange or lip portion 124 of the upper surface 116. The engine 44 is accessible through this access opening 120 for maintenance or other purposes. As illustrated best in FIG. 1, a portion of the exhaust system 62 extends upward, partially through the engine access opening 120. Allowing the exhaust system 62 to partially extend through the access opening 120 allows the raised pedestal 100 to be provided at a lower vertical height.

Figure 3:
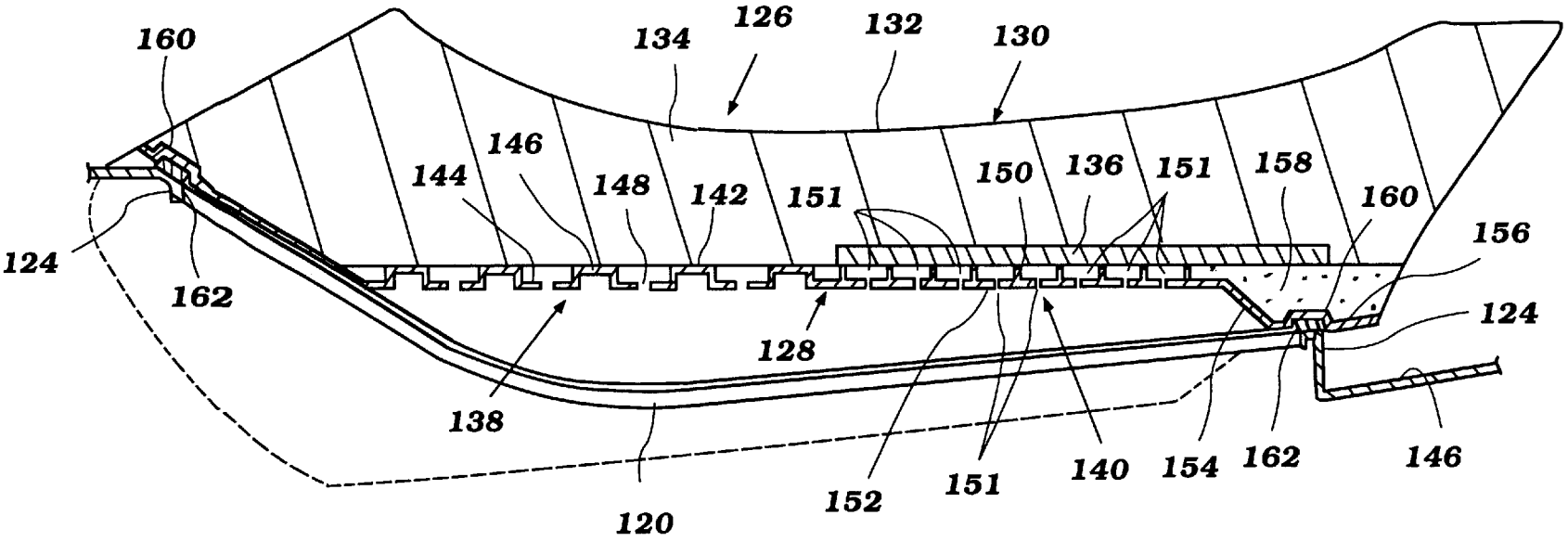

With reference to FIG. 3, a removable front seat 126 is supported by the flange portion 124 of the raised pedestal 100. The seat 126 is removably secured to the raised pedestal 100 through a guide assembly (not shown) located near the front of the seat 126 and a latching assembly (not shown) located near the rear part of the seat 126. The seat 126 includes a seat base 128, a cushion arrangement 130, and a seat skin 132. The seat skin 132 is preferably an artificial leather skin made of polyvinyl chloride (PVC) leather and may include a woolie nylon lining. The seat skin 132 substantially surrounds the cushion arrangement 130 and is hermetically fixed to the periphery of the seat base 128.

The cushion arrangement 130 includes a cushion member 134 and a viscoelastic member 136. The cushion member 134 occupies most of the cushion arrangement 130 and is constructed of a urethane foam. A recess 138 is formed on the underside of the cushion member 134 near the rear of the cushion member 134. The viscoelastic member 136 fits within this recess 138. The viscoelastic member 136 and recess 138 are provided at a location that corresponds to where a rider would typically sit. In an alternative embodiment, the cushion arrangement 130 includes a cushion member 134 having a flat undersurface with viscoelastic member 136 bonded thereto.

The viscoelastic member 136 of the present invention will now be described. As used herein, "viscoelastic" means a material which has both viscous and elastic properties. A viscoelastic member of the type described herein is described in U.S. patent application Ser. No. 08/563,785, filed on Nov. 27, 1995, which is incorporated herein by reference. The viscoelastic member 136 is made of a novel viscoelastic material composed of a urethane elastomer as the matrix resin of the foam material and contains a low density filler to increase its viscosity. The urethane elastomer advantageously has an Ascar C hardness of not more than 15 measured by a durometer for soft materials, such as that available commercially from Kobunshi Keiki in K.K., Japan.

Any one of a number of super-soft urethane elastomers (i.e., urethane elastomers which have an Ascar C hardness of not more than 15) can be used as the matrix resin of the present viscoelastic material. For instance, the super soft viscoelastic urethane elastomer can comprise a mixture of: a tri-functional polyol and difunctional polyol mixture (polyether polyol and polyester polyol); trially isocyanurate; MDI (diphenylmethane-4, 4' diisocyanate)/TDI (tolyene diisocyanate) pre-polymer; Bi-catalyst, Sn-catalyst; and phthalic acid plasticizer. Other viscoelastic urethane elastomers, such as, for example, the urethane resin disclosed in Japanese patent publication Hei 3-17848 (Applicant: IIDA Sangyo K.K.), the super soft elastomer composition disclosed in Japanese unexamined patent publication Hei 3-3217 (Applicant: K.K. Nippon Automation, et al.), and the viscoelastic urethane elastomer matrix resin sold under the trade name ELASCOAT and made by Polyurethane Kasei K.K., can be used as the matrix resin of the present viscoelastic material.

The low density filler mixed in the matrix resin desirably comprises a plurality of resinous microballoons. Each resinous microballoon includes a vinylidenechloride resin (vinylidenechloride acrylonitrile copolymer) shell (average grain size of 40–60 micrometers, grain diameter ranging from 10–100 micrometers) filled with butane gas. Such resinous microballoons are commercially available under the trade name EXPANCEL DE manufactured by EXPANCEL AB of Sweden.

The resinous microballoons desirably are mixed with the super soft urethane elastomer in a sufficient quantity such that the resinous microballoons constitute between one percent and five percent of the weight of the super soft urethane elastomers. It has been found that if the mixing ratio (measured as a percentage of weight of resinous microballoons to super-soft urethane elastomer is less than one percent, the mixture will separate into two layers after molding the viscoelastic material. If the mixing ratio is greater than five percent (as measured as a percentage of weight) the mixture will include an excessive amount of air due to the high viscosity of the material during molding. The ratio of microballoons to the super-soft urethane elastomer therefore should be between one percent and five percent by weight.

The present viscoelastic material including the desired ratio of resinous microballoons to super-soft urethane elastomer advantageously has a lower adhesive property than super-soft urethane elastomer itself. It therefore is easier to handle during the seat assembly process. The material also is lightweight (e.g., has a specific gravity equal to about 0.62) and has a small impact resilience factor compared to other viscoelastic materials. For instance, the present viscoelastic material can have an impact resilience factor equal to about eight percent. The present viscoelastic material also experiences minimal changes in hardness with a given change in temperature as compared with other viscoelastic materials.

Figure 4:
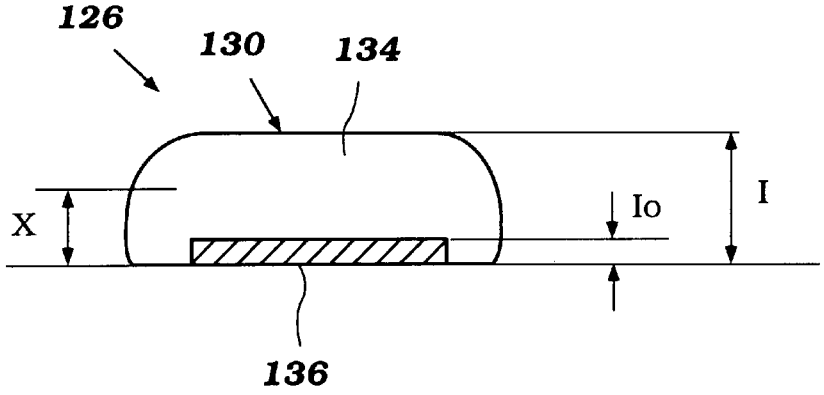
FIG. 4 is a cross-sectional view of a seat constructed in accordance with an embodiment of the invention taken along the width of the seat.
Figure 5:
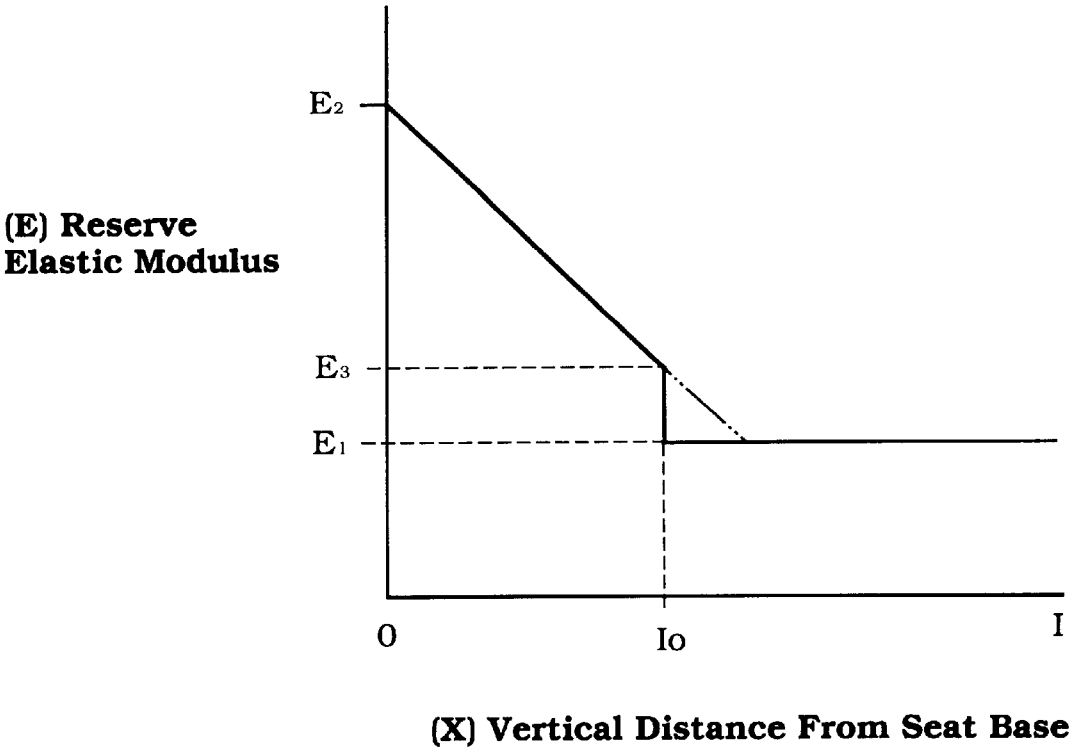
FIG. 5 is a graph showing the relationship between the reserve storage modulus and the vertical distance from a seat base in the seat of FIG. 4.

With reference to FIGS. 4 and 5, an aspect of the present invention will be described. The seat 126 has a reserve elastic modulus E that varies according to the vertical distance X from the seat base 128. The variable "$I_0$" represents the vertical distance from the seat base 128 to the top of the viscoelastic member 136 and the variable "I" represents the distance from the seat base 128 to the top of the seat 126.

FIG. 5 illustrates the relationship between the reserve elastic modulus E in the seat 126 and the vertical distance X in the seat 126 from the seat base 128. The reserve elastic modulus $E_2$ of the seat base (X=0) is relatively high, between 0.065 Mpa and 0.136 Mpa. At the junction of the seat base 128 and the viscoelastic member 136, the viscoelastic member 136 has approximately the same reserve elastic modulus $E_2$ as the seat base 128. The reserve elastic modulus E gradually decreases linearly from the seat base 128 to the top of the viscoelastic member 136. At the top of the viscoelastic member 136, near the junction of the viscoelastic member 136 and cushion member 134, the viscoelastic member 136 has a reserve elastic modulus $E_3$ between 0.022 Mpa and 0.040 Mpa. At this location, the viscoelastic member 136 has a reserve elastic modulus $E_3$ that is approximately the same as the reserve elastic modulus of the cushion member $E_1$, which is between 0.020 Mpa and 0.040 Mpa. Not only is the reserve elastic modulus E approximately the same at the junction of the of the viscoelastic member 136 and cushion member 134 near the top of the viscoelastic member 136, but it is approximately the same at the junction of the viscoelastic member 136 and cushion member 134, in general.

Configuring the reserve elastic modulus E of the viscoelastic member 136 and cushion member 134 to be approximately the same near the junction of the viscoelastic member 136 and cushion member 134 provides a smooth transition in the hardness of the seat material. This improves the comfort of the seat because the rider does not feel an abrupt hardness change between the viscoelastic member 136 and the cushion member 134 in the cushion arrangement 130. The linearly decreasing reserve elastic modulus E has the same effect. It should be noted, in order to prevent discomfort from abrupt hardness changes between the cushion member 134 and viscoelastic member 136, the viscoelastic member 136 may have a gradually changing reserve elastic modulus E not only in the vertical direction, as described above, but also in the longitudinal, transverse, and radial directions.

As mentioned above, extending the exhaust system 62 upwardly, partially through the access opening 120 allows the raised pedestal 100 to provided at a lower vertical height. This is advantageous in that it allows the cushion arrangement 130 of the seat 126 to have a more rounded, comfortable contour. However, this arrangement is disadvantageous in that the heat-emitting exhaust system 62 is provided closer to the viscoelastic member 136 of the seat 126, making the viscoelastic member 136 more prone to heat damage.

In order to protect the viscoelastic member 136 from the heat of the exhaust system 62 and engine 44, the viscoelastic member 136 is at least partially located between the aforementioned ventilation devices. The viscoelastic member is at least partially disposed between the vertical axes L1 and L2 formed by the ventilation hoses 86, 110, respectively. The area of the engine compartment 52 between these two axes L1 and L2 is especially well ventilated because atmospheric air is supplied at opposite ends of this area. The good ventilation in this area causes heat emitted from the engine 44 and exhaust system 62 to be dissipated. Consequently, by locating the viscoelastic member 136 in this well ventilated area the viscoelastic member is protected from possible heat damage caused by the engine 44 and exhaust system 62. Heat damage to the viscoelastic member negatively affects the shock-absorbing properties of the viscoelastic member 136.

In an alternative embodiment, the lower ends 90, 114 of the respective ventilation hoses 86, 110, are positioned more directly beneath the viscoelastic member 136 to improve the ventilation of the viscoelastic member 136 even further.

With reference to FIG. 3, another aspect of the present invention will be described. The seat base 128 has a rigid construction and is preferably made of plastic or sheet metal. The seat base 128 includes a front portion 139 and a rear portion 140. The front portion 139 includes a plurality of adjacent raised and lowered portions 142, 144, respectively. The raised portions 142 include a flat upper surface 146 that directly supports the cushion member 134 of the cushion arrangement 130. The lower portions 144 include airflow openings 148 that allow air to flow out of the cushion arrangement 130 when the seat 126 is compressed and into the cushion arrangement 130 when the seat 126 expands. If this air was not permitted to escape the cushion arrangement 130, the seat 126 would feel quite rigid to the riders, and could possibly rupture.

The rear portion 140 of the seat base 128 includes a plurality of ribs 150 disposed on a flat plate portion 152. The plate portion 152 preferably includes a plurality of air flow openings 151 that allow air to exit and enter the cushion arrangement 130 in the manner described above. It should be noted, however, the air flow openings are not necessary in the rear portion 140 of the seat base 128. Consequently, in an alternative embodiment of the invention, the rear portion 140 does not have air flow openings. The area of the air flow openings 148 in the front portion 138 of the seat base 128 is greater than the area of the air flow openings in the rear portion 140 of the seat base 128. Providing a smaller air flow opening area in the rear portion 140 protects the viscoelastic member 136 from heat damage caused by the heat-emitting engine 44 and exhaust system 62.

The rear portion 140 of the seat base 128 includes a downwardly and rearwardly angled member 154 and connecting flange 156. A urethane foam member 158 rests on this part of the seat base 128 and supports a rearward part of the cushion arrangement 130.

The seat base 128 includes a grooved portion 160 near its peripheral edge. A seal member 162 is disposed between the groove portion 160 and the flange portion 124 of the raised pedestal 100, around the engine access opening 120. The seal 162 helps to prevent water from entering between the seat base 120 and the upper surface 116 of the raised pedestal, and into the cushion arrangement 130 through the air flow openings 148 in the seat base 128. Inhibiting water from entering the cushion arrangement 130 helps to protect the viscoelastic member 136 from water damage. Water between the cushion 134 and viscoelastic member 136 negatively affects the shock-absorbing qualities of the viscoelastic member and can cause the viscoelastic member 136 to become dislodged from the cushion 134, inhibiting the comfort of the seat 126.

From the foregoing description, it should be readily apparent that the watercraft seat of the present invention includes a viscoelastic member that effectively absorbs shock and vibration transmitted to the seat, especially during rough watercraft riding, and is designed to protect the viscoelastic from heat damage. One way that the viscoelastic member is protected against heat from the engine and exhaust system is by providing the viscoelastic member at least partially between a pair of ventilation devices. This causes heat emitted from the engine and exhaust system to be dissipated, effectively cooling the viscoelastic member. Another way that the viscoelastic member is protected from heat damage is by providing a greater air flow opening area in the seat base portion under the cushion than the air flow opening area in the seat base portion under the viscoelastic member. This design allows air to enter and escape the cushion arrangement and protects the viscoelastic member from the heat of the engine and exhaust system. The seal member between the seat base and the raised pedestal helps to protect the viscoelastic member from water damage by inhibiting water from entering between the raised pedestal and the seat base, and into the cushion arrangement through the air flow openings in the seat base.

Of course, the foregoing description is that of a preferred embodiment of the invention, and various changes and modifications may be made without departing from the spirit and scope of the invention, as defined by the appended claims.

What is claimed is:

1. A small watercraft comprising a hull having a length and a width, said hull including a raised pedestal, said raised pedestal having an upper surface, an access opening provided in said upper surface, an engine carried by said hull, at least two ventilation devices provided along the length of said hull on opposite sides of said engine, each ventilation device including a ventilation duct having a lower end opening, a removable seat supported by said raised pedestal, said seat including a seat base, a cushion arrangement, and a seat skin substantially covering said cushion arrangement, said cushion arrangement including a cushion and a viscoelastic member, said viscoelastic member provided between said cushion and said seat base, and arranged along the length of the watercraft at a position where at least part of the viscoelastic member lies between the lower end openings of said ducts of said ventilation devices.

2. The small watercraft of claim 1, wherein said seat base includes a lower surface, a seal engages the upper surface of said raised pedestal and the lower surface of said seat base when said seat is disposed on said raised pedestal so as to inhibit the ingress of water into said cushion arrangement.

3. A small watercraft comprising a hull having a length and a width, said hull including a raised pedestal, said raised pedestal having an upper surface, an access opening provided in said upper surface, an engine carried by said hull and accessible through said access opening, a plurality of ventilation devices provided along the length of said hull, each ventilation device including an air inlet and a ventilation hose, the ventilation hose having an upper and a lower end, the lower end having a vertical axis, a removable seat supported by said raised pedestal, said seat including a seat base, a cushion arrangement, and a seat skin substantially covering said cushion arrangement, said cushion arrangement including a cushion and a viscoelastic member, said viscoelastic member provided at least partially between a pair of said ventilation devices so as to protect said viscoelastic member from heat damage caused by said engine, said viscoelastic member provided at least partially between the vertical axes of a respective pair of said ventilation hoses.

4. A small watercraft comprising a hull having a length and a width, said hull including a raised pedestal, said raised pedestal having an upper surface, an access opening provided in said upper surface, an engine carried by said hull and accessible through said access opening, a plurality of ventilation devices provided along the length of said hull, a removable seat supported by said raised pedestal, said seat including a seat base, a cushion arrangement, and a seat skin substantially covering said cushion arrangement, said cushion arrangement including a cushion and a viscoelastic member, said viscoelastic member provided at least partially between a pair of said ventilation devices so as to protect said viscoelastic member from heat damage caused by said engine, said seat base including a plurality of openings that allow air to enter and exit said cushion arrangement, said seat base including a first base portion located under said cushion and a second base portion located under said viscoelastic member, the area of the openings in said first base portion being greater than the area of the openings in said second base portion.

5. The small watercraft of claim 3, wherein said seat base includes a rigid plate having a plurality of raised and lowered portions, said cushion supported by said raised portions, said openings provided in said lowered portions.

6. A small watercraft comprising a hull having a length and a width, said hull including a raised pedestal, said raised pedestal having an upper surface, an access opening provided in said upper surface, an engine carried by said hull and accessible through said access opening, a plurality of ventilation devices provided along the length of said hull, a removable seat supported by said raised pedestal, said seat including a seat base, a cushion arrangement, and a seat skin substantially covering said cushion arrangement, said cushion arrangement including a cushion and a viscoelastic member, said viscoelastic member provided at least partially between a pair of said ventilation devices so as to protect said viscoelastic member from heat damage caused by said engine, a reserve modulus of elasticity of said viscoelastic member and a reserve modulus of elasticity of said cushion being approximately the same near the junction of said viscoelastic member and said cushion.

7. The small watercraft of claim 6, wherein the reserve modulus of elasticity of said cushion being between 0.020 Mpa and 0.040 Mpa, the reserve modulus of elasticity of said viscoelastic member at a point adjacent to said cushion being between 0.022 Mpa and 0.040 Mpa.

8. A small watercraft comprising a hull having a length and a width, said hull including a raised pedestal, said raised pedestal having an upper surface, an access opening provided in said upper surface, an engine carried by said hull and accessible through said access opening, a plurality of ventilation devices provided along the length of said hull, a removable seat supported by said raised pedestal, said seat including a seat base, a cushion arrangement, and a seat skin substantially covering said cushion arrangement, said cushion arrangement including a cushion and a viscoelastic member, said viscoelastic member provided at least partially between a pair of said ventilation devices so as to protect said viscoelastic member from heat damage caused by said engine, a reserve modulus of elasticity of said viscoelastic member and a reserve modulus of elasticity of said seat base being approximately the same at the junction of said viscoelastic member and said seat base.

9. The small watercraft of claim 8, wherein the reserve elastic modulus of said seat base being between 0.065 Mpa and 0.136 Mpa.

10. A small watercraft comprising a hull having a length and a width, said hull including a raised pedestal, said raised pedestal having an upper surface, an access opening provided in said upper surface, an engine carried by said hull and accessible through said access opening, a plurality of ventilation devices provided along the length of said hull, a removable seat supported by said raised pedestal, said seat including a seat base, a cushion arrangement, and a seat skin substantially covering said cushion arrangement, said cushion arrangement including a cushion and a viscoelastic member, said viscoelastic member provided at least partially between a pair of said ventilation devices so as to protect said viscoelastic member from heat damage caused by said engine, a reserve modulus of elasticity in said viscoelastic member linearly decreasing from a portion in said viscoelastic member adjacent to said seat base to a portion in said viscoelastic member adjacent to said cushion member.

11. A small watercraft comprising a hull having a length and a width, said hull including a raised pedestal, said raised pedestal having an upper surface, an access opening provided in said upper surface, an engine carried by said hull and accessible through said access opening, a plurality of ventilation devices provided along the length of said hull, a removable seat supported by said raised pedestal, said seat including a seat base, a cushion arrangement, and a seat skin substantially covering said cushion arrangement, said cushion arrangement including a cushion and a viscoelastic member, said viscoelastic member provided at least partially between a pair of said ventilation devices so as to protect said viscoelastic member from heat damage caused by said engine, said viscoelastic member being made of a urethane elastomer matrix containing resinous microballoons.

12. The small watercraft of claim 11, wherein a percentage weight ratio of said resinous microballoons to said viscoelastic urethane elastomer matrix is not less than 1% and is not greater than 5%.

13. A small watercraft seat comprising a seat base, a seat cushion arrangement provided on said seat base, said seat cushion arrangement including a cushion member and a viscoelastic member, a seat skin surface substantially surrounding said cushion arrangement, said seat base including a plurality of openings that allow air to enter and escape said cushion arrangement, said seat base including a first base portion located under said cushion and a second base portion located under said viscoelastic member, and the area of the openings in said first base portion being greater than the area of the openings in said second base portion.

14. The small watercraft seat of claim 13, wherein said seat is supported by a raised pedestal of a small watercraft, said seat base includes a lower surface, a seal is provided between the lower surface of the seat base and the raised pedestal so as to inhibit the ingress of water into said cushion arrangement.

15. The small watercraft seat of claim 13, wherein the reserve modulus of elasticity of said viscoelastic member and said cushion are approximately the same near the junction of said viscoelastic member and said cushion.

16. The small watercraft seat of claim 15, wherein the reserve modulus of elasticity of said cushion being between 0.020 Mpa and 0.040 Mpa, the reserve modulus of elasticity of said viscoelastic member at a point adjacent to said cushion being between 0.022 Mpa and 0.040 Mpa.

17. The small watercraft seat of claim 13, wherein the reserve modulus of elasticity of said viscoelastic member and said seat base are approximately the same at the junction of said viscoelastic member and said seat base.

18. The small watercraft seat of claim 17, wherein the reserve modulus of elasticity of said seat base being between 0.065 Mpa and 0.136 Mpa.

19. The small watercraft seat of claim 13, wherein the reserve elastic modulus in said viscoelastic member linearly decreases from a portion in said viscoelastic member adjacent to said seat base to a portion in said viscoelastic member adjacent to said cushion member.

20. The small watercraft seat of claim 13, wherein said viscoelastic member is made of an urethane elastomer matrix containing resinous microballoons.

21. The small watercraft seat of claim 20, wherein a percentage weight ratio of said resinous microballoons to said viscoelastic urethane elastomer matrix is not less than 1% and is not greater than 5%.

22. The small watercraft seat of claim 13, wherein said seat is supported by a raised hull portion, said raised hull portion including a pair of ventilation devices, said viscoelastic member provided at least partially between said ventilation devices.

23. A small watercraft seat comprising a seat base, a seat cushion arrangement provided on said seat base, said seat cushion arrangement including a cushion member and a viscoelastic member, a seat skin surface substantially surrounding said cushion arrangement, said viscoelastic member made of an urethane elastomer matrix containing resinous microballoons, said viscoelastic member provided between said seat cushion and said seat base, the reserve elastic modulus of said viscoelastic member and said cushion being approximately the same near the junction of said viscoelastic member and said cushion, the reserve elastic modulus of a portion of said viscoelastic member adjacent to said cushion member being between 0.022 Mpa and 0.040 Mpa, and the reserve elastic modulus of said cushion member being between 0.020 Mpa and 0.040 Mpa.

24. The small watercraft of claim 23, wherein the reserve elastic modulus of said viscoelastic member and said seat base are approximately the same at the junction of said viscoelastic member and said seat base.

25. The small watercraft of claim 24, wherein the reserve elastic modulus of said seat base is between 0.065 Mpa and 0.136 Mpa.

26. The small watercraft of claim 23, wherein the reserve elastic modulus in said viscoelastic member linearly decreases from a portion in said viscoelastic member adjacent to said seat base to a portion in said viscoelastic member adjacent to said cushion member.

27. The small watercraft of claim 23, wherein said viscoelastic member is made of an urethane elastomer matrix and resinous microballoons.

28. The small watercraft of claim 23, wherein a percentage weight ratio of said resinous microballoons to said viscoelastic urethane elastomer matrix is not less than 1% and is not greater than 5%.

29. The small watercraft seat of claim 13, wherein all of said openings are located on the first base position.

* * * * *